US005867919A

United States Patent [19]

Retulainen

[11] Patent Number: 5,867,919

[45] Date of Patent: Feb. 9, 1999

[54] APPARATUS FOR DRYING A FIBER WEB

[75] Inventor: Elias Retulainen, Kulju, Finland

[73] Assignee: Valmet Corporation, Helsinki, Finland

[21] Appl. No.: 953,204

[22] Filed: Oct. 17, 1997

[30] Foreign Application Priority Data

Oct. 30, 1996 [FI] Finland ..... 964377

[51] Int. Cl.[6] ..... F26B 13/26

[52] U.S. Cl. ..... 34/71; 34/95; 34/116

[58] Field of Search ..... 34/71, 95, 116, 34/119, 123, 124; 162/206, 207; 100/153, 154

[56] References Cited

U.S. PATENT DOCUMENTS

| | | | |
|---|---|---|---|
| 4,461,095 | 7/1984 | Lehtinen | 34/116 |
| 5,706,587 | 1/1998 | Lehtinen et al. | 34/71 |
| 5,778,555 | 7/1998 | Lehtinen et al. | 34/71 |

FOREIGN PATENT DOCUMENTS 9611300 4/1996 WIPO .

*Primary Examiner*—Henry Bennett
*Assistant Examiner*—Steve Gravini
*Attorney, Agent, or Firm*—Ladas & Parry

[57] ABSTRACT

The invention relates to an apparatus for drying a fiber web, in which apparatus the fiber web (5) is dried between two tight bands (1, 2) moving in the same direction and turning around turning rolls (6*a*, 6*b*, 7*a*, 7*b*). The first band (1) is heated by means of a pressure chamber (9) and the second band (2) is cooled by means of a water chamber (10). The fiber web (5) is led together with at least one felt or wire (3, 4) through a drying zone formed by the bands (1, 2) in such a way that the fiber web is in contact with the surface of the first band (1) and the felt or wire (3, 4) is between the fiber web (5) and the cooled second band (2). The surface (11) of the first band (1) bearing against the fiber web (5) is at least partially formed in such a way that reflection from it to a specular reflection angle is reduced substantially. Excessive gloss can then be removed from the surface of the fiber web (5) and the end product to be manufactured of it.

7 Claims, 2 Drawing Sheets

APPARATUS FOR DRYING A FIBER WEB

Figure 1:
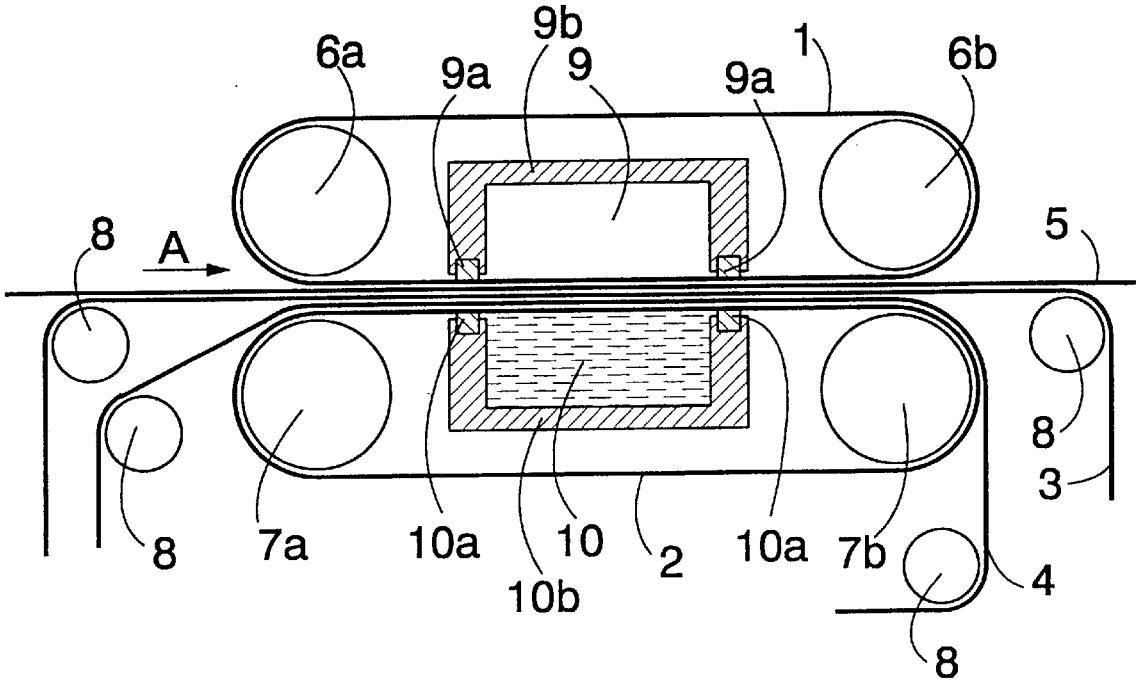

The invention relates to an apparatus for drying a fiber web, the apparatus comprising two endless air impermeable bands, first turning rolls, the first band being arranged to turn around the first turning rolls, and second turning rolls, the second band being arranged to turn around the second turning rolls, whereby the first band and the second band are arranged to run part of the way parallel with each other in such a way that they form a drying zone between them, the first band being arranged to be heated by heating means and the second band being arranged to be cooled by cooling means, whereby the fiber web and at least one felt or wire are led between the bands in such a way that the fiber web is in contact with the heated first band, and the felt or the wire is between the fiber web and the cooled second band, respectively.

Drying a fiber web between two parallel metal bands moving in the same direction in such a way that the fiber web is in contact with the heated metal band and there is a wire between the fiber web and the second cooled metal band so that the steam separated from the fiber web due to heating condenses to the wire by the effect of the cold metal band, is known from several patent publications, from which can be mentioned e.g. International Patent Application WO 96/11300 and U.S. Pat. No. 4,461,095. The operation is based on that two endless metal bands are arranged to run around turning rolls and that pressure chambers containing hot steam and water, respectively, are provided against the inner surface defined by the loops formed by the bands so that the pressure produced presses the hot and the cold band, and respectively, the fiber web and the wire between them towards each other. The bands located between the pressure chambers provide by means of seals one side for the pressure chambers so that the steam and water can directly affect the bands. The operation of the apparatus is fully known per se and has been disclosed e.g. in the above patent publications, which are incorporated herein by reference.

To have control of the smoothness of paper and cardboard surface is important for further processing, end use properties and appearance. It should be possible to affect the surface structure for the purpose of controlling gloss, preventing excessive gloss and removing spottiness, for instance. Further, the surface should preferably be matt so that an ink layer could smooth this roughness and make the printing ink look glossy. Other important properties are absorption properties of surface, adhesion of pigment coating, adhesion of plastic extrusion coating and adhesiveness of the surface to be laminated. In automatic packing machines, for example, it is also important to control the friction so as to be suitable. Sufficiently good results in all respects are not achieved by present apparatuses for drying a fiber web, in which the heated smooth metal band is in contact with the fiber web.

The object of the present invention is to provide an apparatus for drying a fiber web, by means of which apparatus good end products can be manufactured, as far as the control of their properties is concerned.

The apparatus for drying a fiber web according to the invention is characterized in that the surface of the first band bearing against the fiber web is at least partly formed in such a way that reflection from the surface to a specular reflection angle is reduced substantially.

An essential idea of the invention is that the surface of the heated metal band bearing against the fiber web is at least partly formed in such a way that it has substantially no specular reflecting surfaces. Further, the idea of a preferred embodiment is that the surface of the heated metal band bearing against the fiber web is shot blasted. The idea of still another preferred embodiment is that the surface of the heated metal band is furnished with recesses or protrusions for providing patterns similar to said recesses or protrusions on the surface of the fiber web.

An advantage of the invention is that, by using the apparatus for drying a fiber web according to the invention, the gloss and other properties of the end product can easily be made as desired. Moreover, by forming recesses or protrusions on the surface of the heated metal band bearing against the fiber web, it is easy to provide marks or signs or the like, as desired, on the fiber web and so on the end product.

The invention is described in greater detail in the attached drawings,—where

FIG. 1 is a schematic sectional side view, taken in the travel direction of the web, illustrating an apparatus for drying a fiber web according to the invention.

Figure 2:
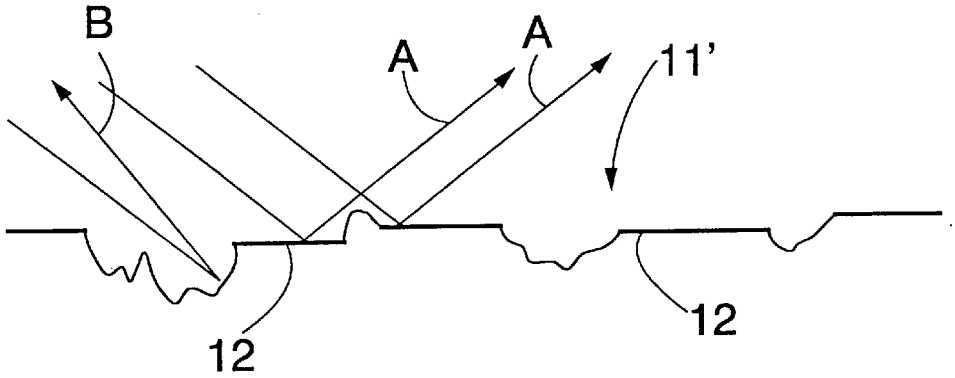
Figure 3:
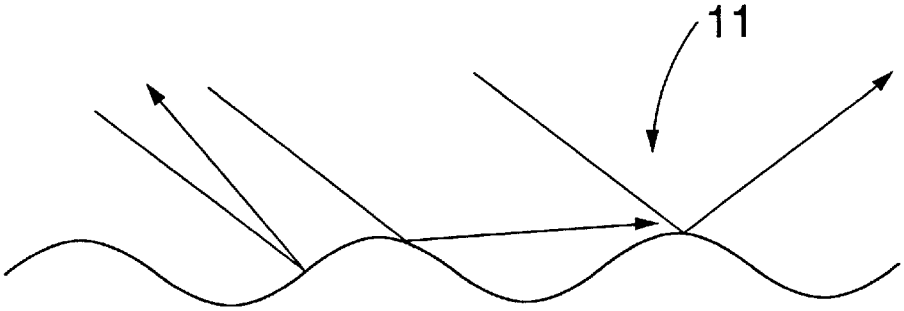
Figure 4:
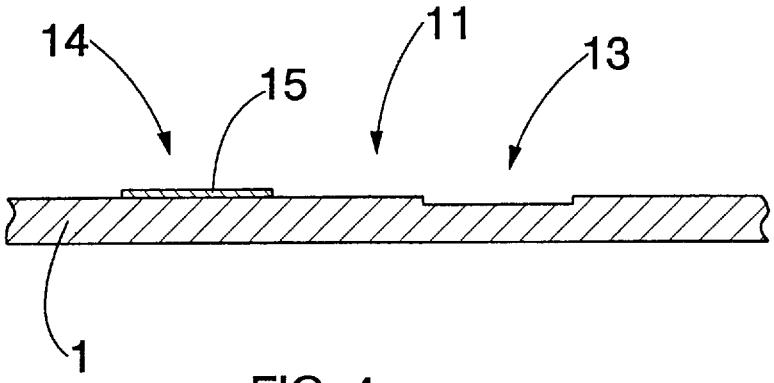
Figure 5:
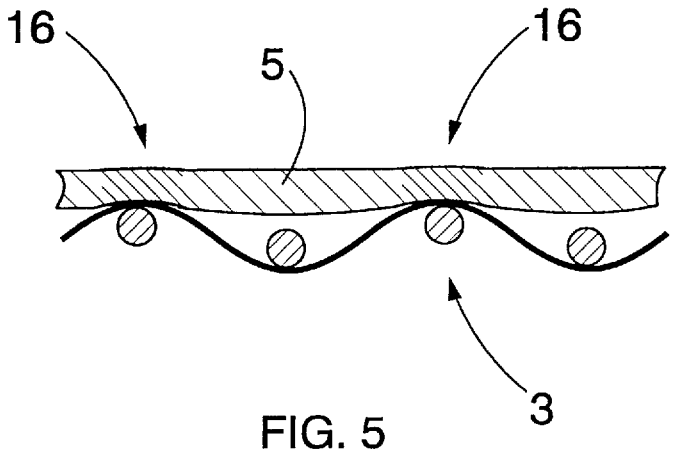

FIG. 2 is a schematic enlarged microscopic side view of a typical surface of a heated band bearing against the fiber web of a prior art apparatus for drying a fiber web, FIG. 3 is a schematic enlarged microscopic side view of a surface of a heated band bearing against the fiber web of the apparatus for drying a fiber web according to the invention, FIG. 4 is a schematic side view of another surface of a heated band bearing against the fiber web of the apparatus for drying a fiber web according to the invention, and FIG. 5 is a sectional side view of a wire and the fiber web of the apparatus for drying a fiber web according to FIG. 1.

FIG. 1 is a schematic sectional side view taken in the travel direction of the web, illustrating a drying apparatus according to the invention. The drying apparatus comprises endless bands that are impermeable to air, conduct heat well and are preferably made of metal: viz. a first band 1, i.e. an upper band, and a second band 2, i.e. a lower band, a fine wire or felt 3, a coarse wire 4 and a fiber web 5 running between those surfaces of the bands that face each other. The fiber web 5 moves in the direction indicated by arrow A. The first band 1 is arranged to turn around first turning rolls 6*a* and 6*b* located at the ends of the drying apparatus. Correspondingly, the second band 2 is arranged to turn around second turning rolls 7*a* and 7*b* also located at the ends of the drying apparatus, below the first turning rolls 6*a* and 6*b*. The wires 3 and 4 are supported and guided by guide rolls 8. Since the pressure prevailing in the drying zone in the area between the bands 1 and 2 is usually different from the pressure prevailing outside or on the sides of the bands 1 and 2, seals are arranged on both sides of the apparatus between or at the edges of the bands 1 and 2, the seals preventing liquid or gas from moving out from the area between the bands 1 and 2 sidewards, or vice versa. To effect vapor heating required by the drying, the drying apparatus comprises a pressure chamber 9, which is located above the first band 1. The first band 1 is sealed with seals 9*a* to the body 9*b* of the pressure chamber 9 so that the steam in the pressure chamber 9 is maintained at a suitable pressure. Below the second band 2 there is a water chamber 10 containing water that cools the second band 2. At the edges of the water chamber 10 there are seals 10*a*, by which the second band 2 is sealed to the body 10*b* of the water chamber 10.

The operation of the drying apparatus is based on heating the first band 1, which is in contact with the web 5, by hot steam contained in the pressure chamber 9. The temperature of the first band 1 causes that the water in the web 5 is vaporized and transferred through the wires 3 and 4 toward the second band 2. The second band 2, in turn, is continuously cooled with water located below it, whereby the steam produced on the surface thereof condenses into water and is removed with the band 2 and the wire 4.

FIG. 2 shows an enlarged microscopic side view of a typical surface 11' of a first band 1 bearing against the fiber web of a prior art apparatus for drying a fiber web. Reference numerals in FIG. 2 correspond to those in FIG. 1. The surface 11' has been smoothed by rolling, for instance, whereby plenty of smooth specular reflecting surfaces 12 have been formed thereon. In FIG. 2, the specular reflecting surfaces 12 are marked on the surface 11' with a thicker line than the remaining parts of the surface. From the specular reflecting surfaces 12, beams of light hitting them are reflected according to arrows A. Naturally, beams of light hitting other parts of the surface than the specular reflecting surfaces 12 are reflected from the surface 11 in a more or less random direction according to arrow B. Because of the specular reflecting surfaces 12, glossy parts impairing e.g. the print quality are formed on the fiber web 5 to be dried and further on the end product, such as paper or cardboard, to be produced from the fiber web 5.

FIG. 3 shows an enlarged microscopic side view of a surface 11 of a first band 1 bearing against the fiber web 5 of the apparatus for drying a fiber web according to the invention. The reference numerals of FIG. 3 correspond to those of the FIGS. 1 and 2. According to the invention, the surface 11 has been formed in such a way that the reflection to the specular reflection angle has been reduced substantially. The reduction has been performed by increasing scattering in other angles evenly. Thus the beams of light directed to the surface 11 scatter in substantially different directions according to the arrows indicated in FIG. 3. Then the surface of the fiber web 5 to be dried and also that of the end products to be manufactured of it will be matt, which causes a very good print quality, for instance. In measurements of surface roughness, for example, it is not necessarily possible to notice a difference in the roughness between the surface 11' according to FIG. 2 and the surface 11 according to the invention shown in FIG. 3. Thus profilometers meters do not necessarily notice any difference whatsoever in the roughness of the fiber web 5 or an end product to be manufactured of it. On the other hand, in case of the surface 11 of FIG. 3, it is possible to find by measurements that the gloss of said end product is less than that of an end product, the fiber web 5 of which is dried by using the surface 11' of FIG. 2.

Specular reflecting surfaces 12 can be removed from the surface 11 of the first band 1 for instance by exposing the surface 11 to shot blasting. Shot blasting can easily be arranged to be directed only to a part of the surface 11 of the first band 1. Then the parts not exposed to shot blasting still have specular reflecting surfaces 12. By directing shot blasting in a desired manner, patterns as desired are provided on the fiber web 5 and on the end product to be manufactured of it, which patterns are formed in such a way that part of the end product is matt and part of it is more glossy. Desired patterns can also be provided by forming either recesses or protrusions on the surface of the first band 1, due to which corresponding protrusions or recesses are provided on the fiber web and the end product, respectively. The protruding patterns or recesses on the first band 1 can easily be provided at the last rolling stage, for instance. A protruding pattern can be caused on the first band 1 also by attaching to the first band 1 a temporary additional part that remains fastened to the first band 1 only as long as recesses will be made in the fiber web. Except by shot blasting, the specular reflecting surfaces 12 can be removed also e.g. by siliconizing the first band 1 or in some other corresponding manner.

FIG. 4 shows a side view of a surface 11 of a first band 1 bearing against the fiber web of another apparatus for drying a fiber web according to the invention. Reference numerals of FIG. 4 correspond to those of the FIGS. 1 to 3. FIG. 4 shows schematically a recess 13 and a protrusion 14 provided on the surface of the first band 1. The protrusion 14 is caused by means of a temporary detachable additional part 15. On account of the scale of FIG. 4, no surface 11 roughness caused by shot blasting can be noticed in FIG. 4.

FIG. 5 shows a partial sectional side view of a wire and a fiber web. Reference numerals of FIG. 5 correspond to those of the FIGS. 1 to 4. The patterns on the wire 3 leave a trace on that side of the fiber web 5 and the end product to be manufactured of it that faces the wire 3. In addition to this, if the pressure is high or the fiber material is very plastic, areas 16 at a higher pressure also affect the optical properties of the end product surface facing the first band 1 and are seen there as traces darker than their surroundings. The texture of the wire 3 causes higher pressure aeas 16 that are shown in the fiber web 5 of the attached figure as denser obliques. By choosing a suitable structure for the wire 3, various regular patterns can be produced both on the back side and the surface side of the fiber web 5 and the end product to be manufactured of it. On the other hand, by providing the surface 11 of the first band 1 according to the invention in such a way that the reflection from the surface to the specular reflection angle is reduced substantially, it is possible to prevent undesired patterns of the wire 3 on the surface side of the end product.

The drawings and the description relating to it are only intended to illustrate the idea of the invention. As to the details, the invention may vary within the scope of the claims. So it is not essential which pressure medium is used in the pressure chamber 9 and the water chamber 10. The medium of the pressure chamber 9 can thus be steam, air, or hot combustion products of fuel, or water, for instance. In addition to water, also e.g. air can be used as medium in the water chamber 10.

In addition to the heating by the pressure chamber 9, the first band 1 can be heated also at other places in manners fully known per se. Further, the heating of the first band 1 can take place entirely outside the pressure chamber 9 or the drying of the fiber web 5 can even take place without a pressure chamber 9.

Moreover, the second band 2 can be cooled also outside the water chamber 10 or the cooling can be implemented even without a water chamber 10 in manners fully known per se.

What is claimed is:

1. Apparatus for drying a fiber web, the apparatus comprising two endless air impermeable bands, first turning rolls, the first band being arranged to turn around the first turning rolls, and second turning rolls, the second band being arranged to turn around the second turning rolls, whereby the first band and the second band are arranged to run part of the way parallel with each other so that they form a drying zone between them, the first band being arranged to be heated by heating means and the second band being arranged to be cooled by cooling means, whereby the fiber web and at least one felt or wire are led between the bands in such a way that the fiber web is in contact with the heated first band, and respectively, the felt or the wire is between the fiber web and the cooled second band, wherein the surface of the first band bearing against the fiber web is at least partly formed in such a way that reflection from the surface to a specular reflection angle is reduced substantially.

2. Apparatus for drying a fiber web according to claim 1, wherein the surface of the first band bearing against the fiber web is only partly formed in such a way that the reflection from the surface to the specular reflection angle is reduced substantially, whereby the surface of the first band forms a repeated pattern on the fiber web.

3. Apparatus for drying a fiber web according to claim 1, wherein the surface of the first band bearing against the fiber web is furnished with recesses, which cause protrusions on the fiber web.

4. Apparatus for drying a fiber web according to claim 1, wherein the surface of the first band is furnished with protrusions, which cause recesses in the fiber web.

5. Apparatus for drying a fiber web according to claim 4, wherein the protrusions formed on the surface of the first band bearing against the fiber web are formed by attaching detachable pieces thereto.

6. Apparatus for drying a fiber web according to claim 1, wherein the surface of the first band bearing against the fiber web is at least partly shot blasted.

7. Apparatus for drying a fiber web according to claim 1, wherein the apparatus comprises a pressure chamber arranged to heat the first band and a chamber containing pressurized medium and arranged to cool the second band.

* * * * *